United States Patent [19]

Buske

[11] 4,169,322

[45] Oct. 2, 1979

[54] MATERIAL TREATMENT

[75] Inventor: Walter E. Buske, Amesbury, Mass.

[73] Assignee: Wolverine Corporation, Methuen, Mass.

[21] Appl. No.: 888,213

[22] Filed: Mar. 20, 1978

[51] Int. Cl.[2] ..... F26B 17/26

[52] U.S. Cl. ..... 34/57 A; 34/232; 34/233

[58] Field of Search ..... 34/57 A, 57 R, 155, 34/232, 233, 37, 164, 224, 225, 241; 68/5 A, 5 B, 5 C, 5 D, 5 E; 131/133 R, 134, 135, 136

[56] References Cited

U.S. PATENT DOCUMENTS

| | | | |
|---|---|---|---|
| 3,060,590 | 10/1962 | Brown | 34/20 |
| 3,166,383 | 1/1965 | Morris | 34/57 A |
| 3,229,377 | 1/1966 | Hoyt | 34/57 A |
| 3,262,217 | 7/1966 | Brown et al. | 34/57 A |
| 3,372,489 | 3/1968 | Brown | 34/57 A |

*Primary Examiner*—John J. Camby

*Assistant Examiner*—Larry I. Schwartz

[57] ABSTRACT

Particulate treatment apparatus includes structure defining a particle treatment zone including a conveyor defining an imperforate lower particle treatment zone boundary. A chamber above the particle treatment zone receives a body of liquid, and means are provided for creating a zone of vapor within the chamber above the body of liquid. Nozzle tubes extend through the lower wall of the chamber and are disposed along the length and across the width of the treatment zone. The upper ends of the nozzle tubes extend above the level of liquid in the chamber while the lower ends of the tubes are disposed adjacent the imperforate transport surface of the conveyor. Vapor flows from the vapor zone through the tubes downwardly against the conveyor surface and fluidizes particles on the conveyor with concurrent vapor exchange so that the particulate material entrains a substantial amount of vapor as it is transported through the treatment zone.

9 Claims, 2 Drawing Figures

FIG 1
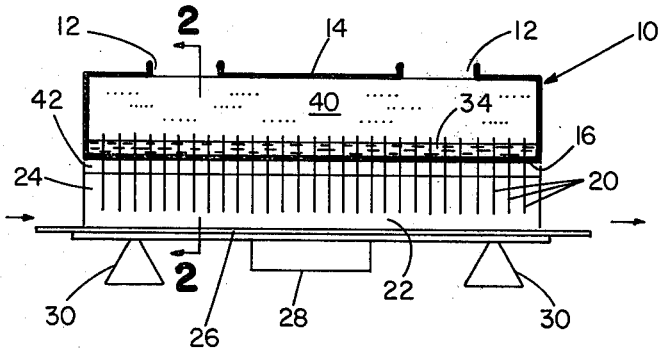
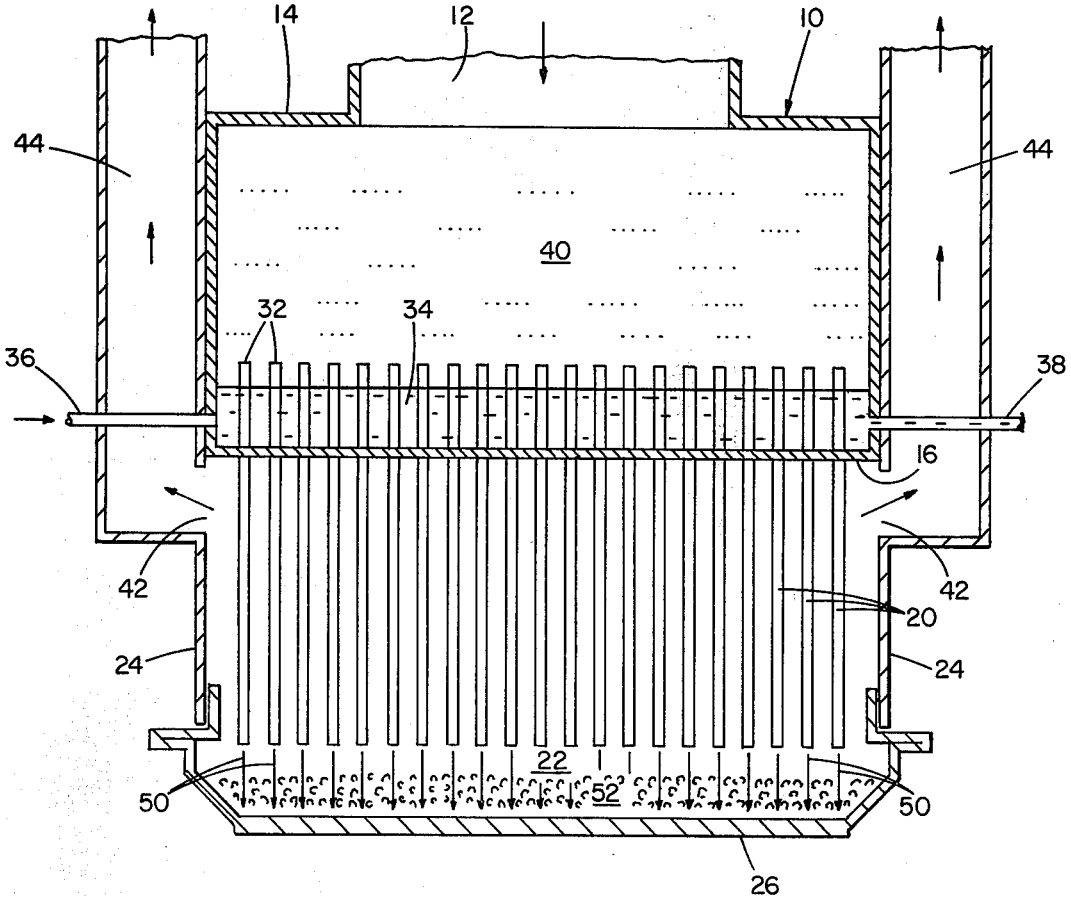
FIG 2

MATERIAL TREATMENT

This invention relates to material treatment systems that employ a gaseous medium to fluidize particles in heat exchange or other treatment relation and more particularly to particulate material treatment systems which use transport mechanisms of the oscillatory conveyor or similar type.

Particulate material is advantageously treated by maintaining the particles in fluidized condition as they are transported through a particle treatment zone. In particular treatment apparatus, as shown in U.S. Pat. No. 3,229,377, for example, gas jets are directed downwardly onto an imperforate surface, the gas jets tending to blow particles away from the surface areas directly beneath the jets and being deflected radially for flow under particles in a fluidizing action. The gas flow frequently interacts with the particles in heat exchange or other treatment relation. In particular applications, for example in the cereal industry, it is desired to increase the moisture content of cereal flakes. In one arrangement, cereal flakes are held in a rotating drum and water is sprayed directly onto the flakes. Among the limitations of such arrangements are excessive damage to the flakes, nonuniform moisturizing, and tendencies to plug. In another arrangement, externally humidified air has been supplied to apparatus of the type shown in the above mentioned U.S. patent.

The present invention provides particulate treatment apparatus that includes structure defining a particle treatment zone including a conveyor defining an imperforate lower boundary of the particle treatment zone. A chamber above the particle treatment zone is arranged to receive a body of liquid and means are provided for creating a zone of vapor within the chamber above the body of liquid. An array of nozzle tubes extend through the lower wall of the chamber and are disposed along the length and across the width of the treatment zone. The upper ends of the nozzle tubes extend above the level of liquid in the chamber while the lower ends of the tubes are disposed adjacent the imperforate transport surface of the conveyor. Vapor flows from the vapor zone through the tubes downwardly against the conveyor surface and fluidizes particles on the conveyor with concurrent vapor exchange so that the particulate material entrains a substantial amount of vapor as it is transported through the treatment zone.

In a particular embodiment, the apparatus is of food grade construction and the conveyor is of the oscillatory type with drive means for imparting an oscillatory motion of about one inch amplitude at a frequency in the range of 100–400 cycles per minute. The length of the nozzle tubes below the lower support wall of the chamber is about five times the length of those nozzle tubes above that support wall, and the upper ends of those tubes are disposed about one inch above the surface of the liquid in the supply plenum. In this embodiment, the liquid is water and is supplied to maintain a substantially constant water level in the chamber. The water is heated by injection of live steam (and supplemental heating means may be used as appropriate) to establish to provide a vapor density in the zone above the water of at least 90% saturation at a temperature about 120° F. Pressure in the supply plenum in the range of 2–5 inches of water provides jets of vapor through the nozzle tubes and downwardly against the conveyor surface for concurrent fluidization of and vapor exchange with particles on the conveyor.

The invention provides a versatile and efficient particle fluidization and vapor exchange system and is particularly useful with particle transport mechanisms of the oscillatory conveyor type. Other features and advantages of the invention will be seen as the following description of a particular embodiment progresses, in conjunction with the drawings, in which:

FIG. 1 is a diagrammatic longitudinal sectional view of particle treatment apparatus in accordance with the invention; and FIG. 2 is a transverse cross-sectional view taken along the line 2—2 of FIG. 1.

DESCRIPTION OF PARTICULAR EMBODIMENT

The particulate material treatment apparatus shown in FIGS. 1 and 2 includes a gas supply and distribution structure which includes supply plenum 10 having inlets 12 in its upper wall 14 and a transverse lower wall 16 through which extend in fluid tight relation an array of gas distribution nozzle tubes 20. Below supply plenum 10 is an enclosure 22 which defines a particle treatment zone. The enclosure has side walls 24 and oscillatory conveyor 26 defines the lower boundary of the particle treatment zone. A suitable drive, diagrammatically indicated at 28, drives conveyor pan 26 in conventional manner. The conveyor mechanism is mounted on suitable supports diagrammatically indicated at 30.

Each tube 20 is twenty-four inches in length and has an inner diameter of ¾ inch. The tubes are arranged in transverse rows with the tubes spaced at transverse intervals of 3½ inches on center and the transverse rows spaced lengthwise at intervals of 2½ inches on center. The upper ends 32 of tubes 20 are located about four inches above the lower wall 16 of supply plenum 10. Water is supplied to chamber 10 and maintained at a level of about three inches so that the upper ends 32 of tubes 20 extend above the surface of water 34. Connected to chamber 10 are lines 36 which are connected to a source of steam so that live steam is directly injected into water 34 to heat the water and create a zone 40 of vapor within chamber 10. Alternative or supplemental heating means may be used as desired. Suitably conditioned air is supplied to plenum 10 through ports 12 to establish a pressure of about four inches of water in the vapor zone 40. The supply gas may be conditioned by heating, cooling or otherwise as desired.

Vertical walls 24, as shown in FIG. 2, extend downwardly on either side of the array of tubes 20 and define side boundaries of the treatment zone. At the upper end of each side wall 24 are formed elongated exhaust ports 42 which communicate with exhaust passages 44 that extend upwardly from the treatment zone along either side of supply plenum 10. Fans or other conventional air-moving devices (not shown) create a pressure differential between the supply plenum 10 and exhaust passages 44, and a resulting series of downwardly flowing vapor jets through nozzle tubes 20. Conveyor pan 26 forms the lower boundary of the treatment zone and typically is driven at a rate of about 250 cycles per minute with an excursion of one inch amplitude for transporting particles through the treatment zone. Vapor is flowed from vapor zone 40 through tubes 20 in high velocity streams 50 directed perpendicularly downwardly towards the imperforate surface of conveyor pan 26. The velocity of jets 50 is such that they tend to blow particles 52 away from the conveyor surface areas directly beneath the jets and thus expose those areas. When the jets 50 impact the imperforate conveyor surface, the vapor is deflected radially outward from the axis of each jet substantially uniformly around a 360° arc. This flow of vapor tends to pass under particles and contribute to the fluidizing action as well as expose the particles to vapor transfer so that a substantial portion of the vapor in the jets is entrained by the particles. The gases then flow upwardly for exhaust through ports 42 and passages 44.

Thus, the invention provides compact, efficient apparatus for concurrent fluidization and vapor transfer treatment of particulate material. While a particular embodiment of the invention has been shown and described, various modifications will be apparent to those skilled in the art and therefore it is not intended that the invention be limited to the disclosed embodiment or to details thereof and departures may be made therefrom within the spirit and scope of the invention.

What is claimed is:

1. Particulate treatment apparatus comprising structure defining a particle treatment zone including a conveyor defining an imperforate lower particle treatment zone boundary, a chamber above said particle treatment zone arranged to receive a body of liquid, means for creating a zone of vapor within said chamber above said body of liquid, an array of nozzle tubes extending through the lower wall of said chamber and disposed along the length and across the width of said treatment zone, the upper ends of said nozzle tubes extending above the level of liquid in said chamber and the lower ends of said tubes being disposed adjacent said imperforate transport surface of the conveyor, and means for flowing vapor from said vapor zone through said tubes downwardly against said conveyor surface for fluidizing particles on said conveyor with concurrent vapor exchange so that the particulate material entrains a substantial amount of vapor as it is transported through the treatment zone.

2. The apparatus as claimed in claim 1 wherein said conveyor is of the oscillatory type.

3. The apparatus as claimed in claim 2 wherein said oscillatory conveyor includes a drive that has an operating frequency in the range of 100–400 cycles a minute and imparts oscillatory motion of about one inch amplitude to said imperforate conveyor boundary member.

4. The apparatus as claimed in claim 1 wherein the length of said nozzle tubes above said chamber lower wall is at least ten percent of the length of said nozzle tubes below said chamber lower wall.

5. The apparatus as claimed in claim 1 and further including means for supplying liquid to said chamber to maintain a substantially constant liquid level within said chamber below but immediately adjacent the tops of said nozzle tubes.

6. The apparatus as claimed in claim 5 and further including liquid heating means for creating said zone of vapor within said chamber above said body of liquid.

7. The apparatus as claimed in claim 6 wherein said liquid is water and said liquid heating means includes means for injecting steam into said water.

8. The apparatus as claimed in claim 1 and further including gas circulation means for creating a pressure in said chamber of at least two inches of water for flowing vapor jets from said nozzle tubes against said imperforate conveyor boundary.

9. The apparatus as claimed in claim 8 wherein said conveyor is of the oscillatory type and includes a drive that has an operating frequency in the range of one hundred to four hundred cycles per minute and imparts oscillatory motion of about one inch amplitude to said imperforate conveyor boundary member, the length of said nozzle tubes above said chamber lower wall is at least ten percent of the length of said nozzle tubes below said chamber lower wall and further including means for supplying water to said chamber to maintain a substantially constant water level within said chamber below but within a distance of about one inch from the tops of said nozzle tubes, and means for heating said water for creating said zone of vapor within said chamber above said body of water at a vapor density corresponding to at least ninety percent saturation at a temperature of 120° F.

* * * * *